US007281288B1

(12) United States Patent
McKay

(10) Patent No.: US 7,281,288 B1
(45) Date of Patent: Oct. 16, 2007

(54) CLEANING APPARATUS WITH FLEXIBLE CONNECTION BETWEEN HEAD AND HANDLE

(75) Inventor: William D. McKay, Grand Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 760 days.

(21) Appl. No.: 10/672,912

(22) Filed: Sep. 26, 2003

(51) Int. Cl.
*A47L 13/20* (2006.01)
*A47L 13/24* (2006.01)
*A47L 25/00* (2006.01)
*A47L 25/08* (2006.01)

(52) U.S. Cl. ..... 15/144.2; 15/144.1; 15/230.11; 15/104.002; 492/19; 16/430; 16/900

(58) Field of Classification Search ..... 15/144.2, 15/144.1, 172, 230.11, 231, 229.6, 104.002; 492/13, 19; 16/110.1, 430, 900
See application file for complete search history.

(56) References Cited

U.S. PATENT DOCUMENTS

| | | | | | |
|---|---|---|---|---|---|
| 603,694 | A | * | 5/1898 | Kavanaugh | 403/120 |
| 717,377 | A | | 12/1902 | Flanders | |
| 1,982,910 | A | * | 12/1934 | Forbes et al. | 403/100 |
| 2,529,927 | A | | 11/1950 | Fisk | |
| 2,694,826 | A | | 11/1954 | Blakely | |
| 3,011,499 | A | | 12/1961 | Tajan | 401/139 |
| 3,056,154 | A | | 10/1962 | Neal | 15/104 |
| 3,102,544 | A | | 9/1963 | Keegan et al. | 132/147 |
| 3,158,887 | A | | 12/1964 | Kanbar et al. | 15/104 |
| 3,299,461 | A | | 1/1967 | Marks | 15/104 |
| 3,340,556 | A | * | 9/1967 | Allen | 15/159.1 |
| 3,373,457 | A | | 3/1968 | Rouch, Jr. | 15/104 |
| 3,395,416 | A | * | 8/1968 | Hughes | 15/228 |
| 3,665,543 | A | | 5/1972 | Nappi | 15/215 |
| 3,699,603 | A | * | 10/1972 | Popeil | 15/120.1 |
| 3,755,847 | A | | 9/1973 | Liebscher | |
| 3,833,008 | A | | 9/1974 | Blackett, Jr. | |
| 4,062,083 | A | | 12/1977 | McKay | 15/106 |
| 4,107,811 | A | | 8/1978 | Imsande | 15/215 |
| 4,244,587 | A | | 1/1981 | Schweizer | 15/104.8 |
| 4,307,739 | A | | 12/1981 | Chern | |
| 4,361,923 | A | | 12/1982 | McKay | 15/104 |
| 4,399,579 | A | | 8/1983 | McKay | 15/104 |
| 4,422,201 | A | | 12/1983 | McKay | 15/104 |
| 4,517,703 | A | | 5/1985 | Koke | |
| 4,727,616 | A | | 3/1988 | Kucera et al. | 15/104 |
| 4,742,547 | A | | 5/1988 | Watanabe | 15/104 |
| 4,850,073 | A | | 7/1989 | Preuss | 15/207.2 |
| 4,856,541 | A | | 8/1989 | Kellett et al. | |
| 4,905,337 | A | | 3/1990 | McKay | 15/104 |
| 5,002,075 | A | | 3/1991 | Kellett et al. | |
| 5,027,465 | A | | 7/1991 | McKay | 15/104 |
| D320,680 | S | | 10/1991 | Stetson et al. | D30/158 |
| 5,052,071 | A | | 10/1991 | Halm | 15/167.1 |
| 5,261,426 | A | | 11/1993 | Kellett et al. | |

(Continued)

*Primary Examiner*—Gary K Graham
(74) *Attorney, Agent, or Firm*—Gottlieb, Rackman & Reisman

(57) ABSTRACT

An improved cleaning tool is provided with a flexible connection between the head or spindle and the handle. The improved tool broadly includes a spindle or head, a handle and a flexible connection between the head and handle to permit relative pivotal movement therebetween and rubber bumpers to protect against scratching furniture. The flexible connection regulates relative movement between the spindle head in such a way that lateral movement is greater than the up and down movement.

18 Claims, 8 Drawing Sheets

U.S. PATENT DOCUMENTS

| | | | | |
|---|---|---|---|---|
| D342,610 | S | 12/1993 | Stetson et al. | D4/122 |
| 5,406,670 | A * | 4/1995 | Juratovac et al. | 15/229.2 |
| D363,214 | S | 10/1995 | Parola et al. | D9/300 |
| 5,519,912 | A | 5/1996 | Kawamura | |
| 5,600,865 | A | 2/1997 | Morrison | |
| 5,651,158 | A | 7/1997 | Halm | 15/167.1 |
| 5,819,989 | A | 10/1998 | Saraceni | 221/192 |
| 5,862,563 | A | 1/1999 | Hartmann | |
| 5,878,457 | A | 3/1999 | Cox et al. | 15/104.002 |
| 5,887,600 | A | 3/1999 | Wilk | |
| 5,890,255 | A | 4/1999 | Robinson | |
| 5,904,150 | A | 5/1999 | Caristo et al. | |
| 6,006,393 | A | 12/1999 | Lynch et al. | 15/144.1 |
| 6,014,788 | A | 1/2000 | Jaffri | 15/104.002 |
| 6,021,542 | A | 2/2000 | Norman | |
| 6,029,307 | A | 2/2000 | Baudoin | |
| 6,055,695 | A | 5/2000 | McKay, Jr. | 15/104.002 |
| 6,070,597 | A | 6/2000 | Motherhead | |
| 6,098,635 | A | 8/2000 | Marino | 132/238 |
| 6,112,362 | A | 9/2000 | Parko et al. | |
| 6,127,014 | A | 10/2000 | McKay, Jr. | 428/43 |
| 6,230,716 | B1 | 5/2001 | Minoletti | |
| 6,279,189 | B1 * | 8/2001 | Cassar | 15/144.1 |
| 6,298,517 | B1 | 10/2001 | McKay | 15/228 |
| 6,325,070 | B1 | 12/2001 | Tyroler et al. | 132/112 |
| 6,405,403 | B1 | 6/2002 | McKay | 15/228 |
| 6,502,585 | B1 | 1/2003 | Mazzei et al. | |
| 2002/0148062 | A1 * | 10/2002 | Charbeneau | 15/230.11 |
| 2003/0056311 | A1 * | 3/2003 | Broecker et al. | 15/167.1 |
| 2003/0116171 | A1 | 6/2003 | Loveless | |
| 2003/0229958 | A1 | 12/2003 | Thompson et al. | |
| 2004/0181892 | A1 | 9/2004 | Chen | |

* cited by examiner

CLEANING APPARATUS WITH FLEXIBLE CONNECTION BETWEEN HEAD AND HANDLE

BACKGROUND

The present invention relates generally to devices for cleaning floors with revolving adhesive lint rollers and non-woven peelable sweepers and mops Adhesive lint rollers for clothing and floors as well as Swiffer™ style swivel sweepers have enjoyed substantial commercial success for use in certain applications. For example, an average home owner can use a Swiffer™ style sweeper and peel, place and replace one cleaning sheet at a time upon the sweeper head. The problem is that these types of sweeper heads have single sided cleaning surfaces; although coupled with swivel movement of the head. It would be desirable to provide a similar swivel action; but with a dual cleaning surface rotatable about an axle.

Many adhesive lint rollers for use on floors are commercially available and are modeled after typical paint rollers that are limited to bent metal combined with a plastic handle. This sort of paint roller style handle for the adhesive floor rollers is lacking in that it does not provide a swivel or pivoting action to provide ergonomical movement of the head over floor and upholstery surfaces and around furniture legs, corners and steps.

Accordingly it would be desirable to provide an improved cleaning tool having a flexible connection between the head and the handle. The improved connection should limit the extent of relative movement between the head and handle so that the spindle-head has limited movement in the vertical cleaning direction. The cleaning tool head should move more freely in the lateral direction than it does in the back and forth cleaning direction.

SUMMARY

The present invention broadly provides an improved cleaning tool with a variable flexible connection between the head and handle.

The improved tool broadly includes a spindle roller or an oblate head for receiving a tape roll or an oblate mop head, a handle and a head with an axle upon which the spindle head rotates, and a flexible connection between or in the parts to permit relative movement there between.

The handle may be tubular and may be provided with an internally threaded portion which is adapted to receive the threaded marginal end portion of a hand tool and, preferably, an additional extension pole. The handle may have at least one cushioned grip portion that makes the handle feel more comfortable to the user. The cushioned grip may be formed of a suitable thermoplastic elastomer, such as a polyolefin. The body may be formed of a suitable plastic with soft rubber inserts or coatings placed as bumpers in areas that may come in contact with furniture. This is to avoid scratching the delicate furniture surface.

In one aspect, the body, flexible connection and at least a portion of the handle are formed of a flexible, unbreakable soft material, such as polypropylene. The connection has a web portion that is more flexible to movement in one plane than it is to movement in another generally perpendicular plane. This web portion has major and minor transverse dimensions. In the one aspect, the web portion may have a substantially rectangular transverse cross-section. Optionally the web area may be filled and/or surrounded with an elastomeric material between the web areas to limit movement.

Optionally, the flexible connection may be made of at least one transverse U-shaped fold formed with the remainder of the body or optionally as a separate connector between the body and the handle. The U-shaped folds are preferable positioned in a plane at from 30° to 150°, preferably substantially at right angles, to the plane in which the handle lies, whereby the resiliently flexible connector permits the body and/or the head to be moved at an angle to the handle or grip portion out of the plane in which it normally lies, and then to revert to its original position on the release of pressure.

BRIEF DESCRIPTION OF THE DRAWING

The various features, advantages and other uses of the present invention will become more apparent by referring to the following detailed description and drawing in which.

DETAILED DESCRIPTION

Figure 1:
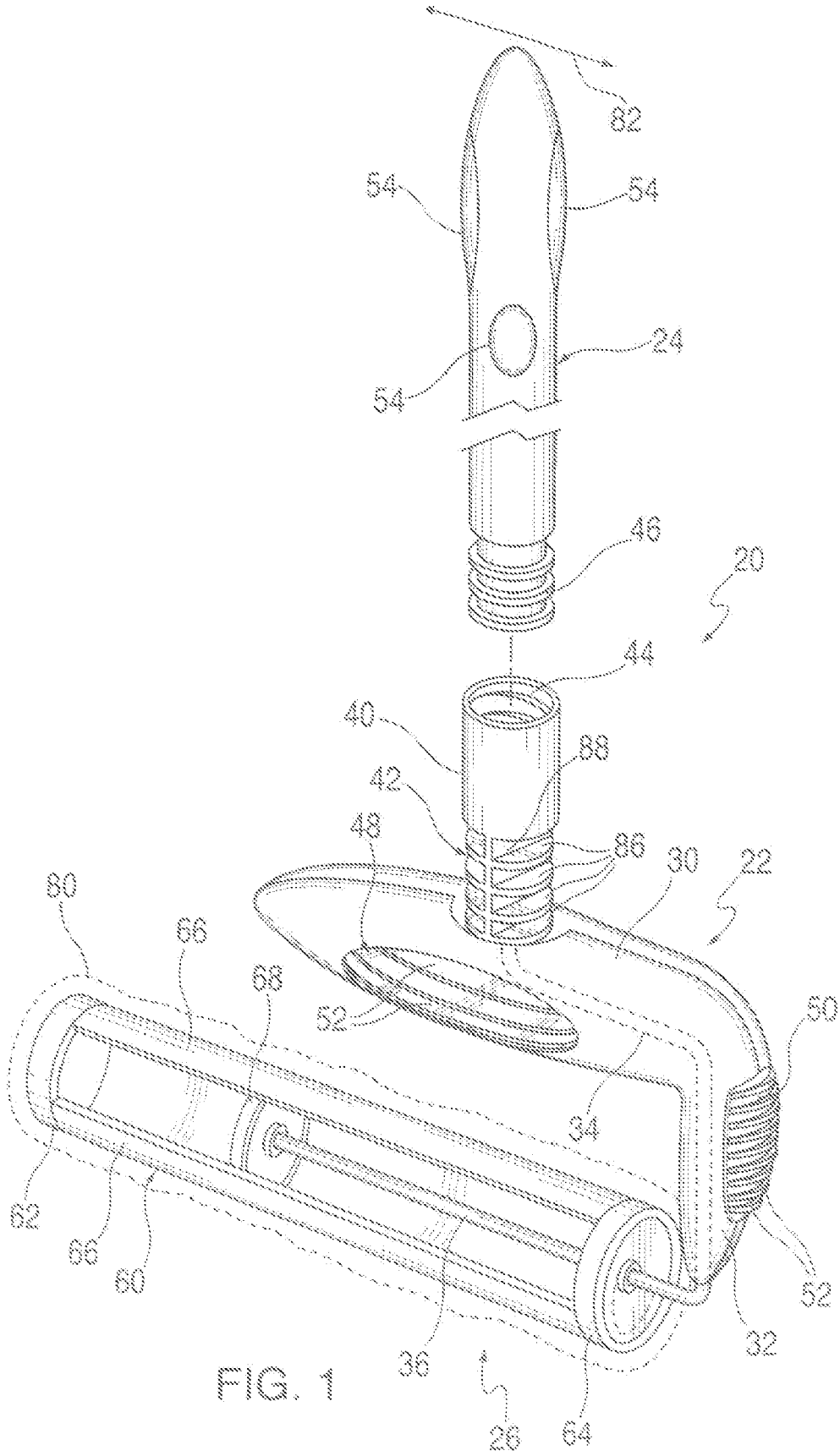
FIG. 1 is a front perspective view of one aspect of the present cleaning apparatus.

Refer now to the drawing, and to FIG. 1 in particular, there is depicted a cleaning apparatus 20 constructed in accordance with the teachings of the present invention.

The cleaning apparatus 20 includes a body or head 22, a handle 24 and a spindle 26. The head 22 is formed of a suitable lightweight material, preferably a plastic material, with poly-propylene and poly-ethylene being suitable materials by way of example only.

The head 22 includes an upper arm 30 and a side arm 32. The upper and lower arms 30 and 32 may be formed as a one piece molded structure by suitable molding processes, such as by blow molding or injection molding, for example, or as separate members. The upper arm 30 and the side arm 32, while integrally joined, may be formed in a plurality of sections, with separate halves being shown in FIG. 2, for example, and joined together by adhesive, fasteners, and/or snap-together connections.

The side arm 32 depends from one end of the upper arm 30. One or more optional inserts 48 and 50 are mounted on the head 22, with at least one insert 48 mounted on one or both sides of the upper arm 30 and one insert 50 mounted on the outer surface of the side arm 32. The inserts 48 and 50 are formed of a resilient material, such as an elastomer or rubber, and may include a plurality of resilient ribs 52. The inserts 48 and 50 are positioned to act as bumpers to prevent contact between the head 22 and external surfaces during use of or coated with the cleaning apparatus 20. Alternately, the entire head 22 can be formed of a resilient material.

A reinforcing member 34, such as a metal rod, may be disposed within the head 22 and has a curvilinear shape, as shown in FIG. 1. One end of the reinforcing member or rod 32 is fixed in the upper arm 34. The other end portion of the reinforcing member 36 or rod 34 projects laterally inward from the side arm 32 in a spaced, generally parallel position to the upper arm 34. The purpose of the end portion 32 of the rod 34 will be described in greater detail hereafter.

A shaft 40 is coupled to the upper arm 30 by means of a flexible or resilient connector means 42. The shaft 40 has a generally circular cross-section with an internally threaded bore 44 which is adapted to mate with threads 46 extending from one end of the handle 24 to releasably connect the handle 24 to the head 22 and to enable different length handles to be interchangeably connected to the head 22 as also described hereafter.

The handle 24 has an elongated shape and a length which may vary depending on the particular application of the apparatus 20. A long length handle 24 as shown in FIG. 1 by way of example only, to enable the cleaning apparatus 20 to function as a floor mop or as a mop for hard to reach surfaces. Alternately, a shorter length handle may be mounted in the shaft 40 for hand use of the cleaning apparatus 20 to clean clothes, furniture, etc.

Resilient inserts 54, similar to the inserts 48 and 50, may be mounted at various locations on the handle 24 to form an ergonomic, high-friction grip surface.

The spindle 26 is shown in FIG. 1 as being rotatable. Also, the head 22 and rod 34 maybe molded or formed in one piece.

The spindle 26, in the aspect of the cleaning apparatus 20 shown in FIG. 1, includes a cartridge 60 formed of first and second end caps 62 and 64 which are joined by a plurality of longitudinally extending strips 66. The end caps 62 and 64 have a generally circular shape so as to form the cartridge 60 in the shape of a cylinder. At least one of the end caps, such as end cap 64, has a through aperture through which the end portion of the rod 36 extends. An interior bearing member 68, having a shape similar to that of the end caps 62 and 64 is fixedly mounted intermediately between the end caps 62 and 64 within the strips 66. The bearing 68 includes a receiver for rotatably receiving the end portion 36 of the reinforcement member or rod 34. Alternately, the end portion 36 of the rod 34 may be provided with extra length so as to extend completely through the cartridge 60 to the end cap 62 wherein it is rotatably supported in a boss, not shown, in the end cap 62.

In this manner, the cartridge 60 is rotatably coupled to the head 22 by the reinforcement member or rod 34 and is capable of bi-directional rotation as pressure is applied to the cartridge 60 through the head 22 and the handle 24 by a user.

Figure 2:
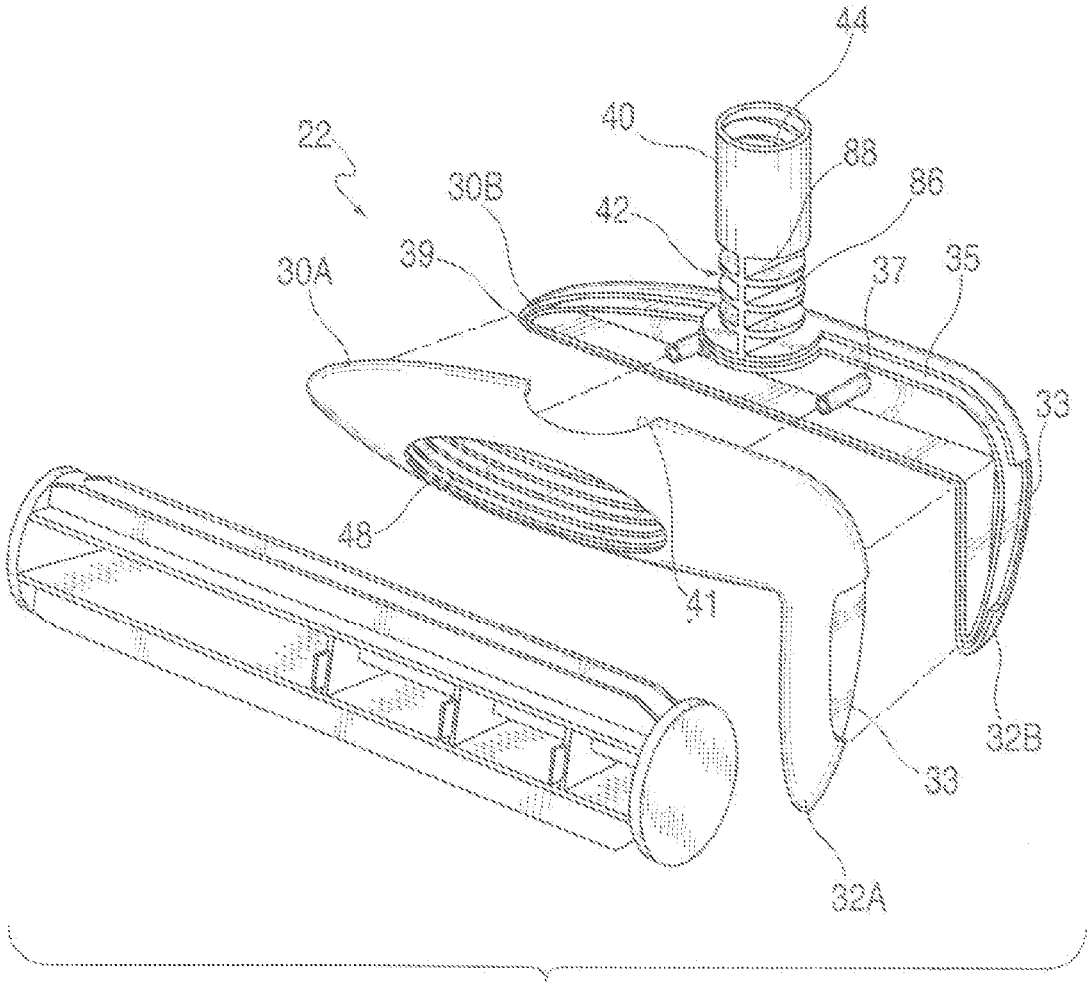
FIG. 2 is an exploded, front elevational view of another aspect of the cleaning apparatus of the present invention.

As shown in FIG. 2, the two-part construction of the head 22 is depicted by way of example only. In this aspect of the invention, the upper arm 30 and the integral side arm 32 are formed in two sections 30A and 32A, and 30B, and 32B, respectively. One insert 48 can be mounted on both of the upper arm portions 30A and 30B.

A recessed shoulder 35 is formed in one of the head halves, such as along the edge of the upper arm 30B and the side arm 32B for engagement with a mating edge on the opposed upper arm 30A and side arm 32A.

At least one, and preferably a plurality of bosses 37, are formed in one of the head halves and receive smaller diameter pins, not shown, on the mating half to align and secure the head halves together.

As also shown in FIG. 2, the head half formed of the upper arm 30B and side arm 32B includes an enlargement 39 projecting from the shoulder also has a recessed shoulder like the recess 35 for mating engagement with a recess 41 in the opposed upper arm 30A. The enlargement 39 carries a connector 42 and a shaft 40 so that the connector 42 is physically located on only one of the head halves for strength and proper function.

As shown in FIG. 1, a cleaning element 80 is mounted on the cartridge 60. In the case of the rotatable, cylindrically shaped cartridge 60, the cleaning element 80 can be in the form of a roll of separable sheets of a film or substrate having an outwardly facing adhesive surface suitable for picking up lint, dirt, etc., from hard surfaces, soft fabrics, clothes, animals, etc. The length and width of the separable sheets as well as the length of the cartridge 60 may be varied to suit the needs of different applications. When the outermost sheet of the cleaning element 80 is soiled or dirty, it is peeled from the roll supported on the cartridge 60 to expose a fresh, clean sheet for further cleaning operations.

According to the present invention, the unique connector 42 in the cleaning apparatus 20 provides a pivotal or swivel function for ergonomic feel and effective use of the cleaning apparatus 20 over a number of different surfaces, or different shaped surfaces. All aspects of the connector 42, including those described and illustrated hereafter, are formed to exhibit more flex in one plane than in an opposite, angularly opposed plane, such as a perpendicular plane.

For purposes of clearly understanding the operation of the connector 42 and the other connectors described hereafter, reference planes will be provided for clarity. As shown in FIG. 1, the upper arm 30 has a longitudinally extending axis extending between the side arm 32 and an opposed end generally parallel to a lower end. A plane through this axis and the handle 24 defines a first plane. The handle 24 is also located in a second plane, mutually perpendicular to the first plane. The connector 42, is designed to allow significant movement, i.e., 30° to 150° of the handle 24 in either direction of arrow 82 in the first plane; while enabling only manual movement, i.e., 20° in the second plane. This movement provides an ergonomic use of the cleaning apparatus 20 as well as a more efficient cleaning since pressure variations which may result from the angular application of pressure from the user to the handle 24 are compensated for by the pivotal movement of the handle 24, relative to the head 26 through a connector 42.

In the aspect of the connector 42 shown in FIGS. 1 and 2, the connector 42 includes of a plurality of segments 86 each having a generally planar shape. Although the segments 86 are depicted in FIG. 2 as having a circular periphery, it will be understood that other polygonal, oval, elliptical, etc., shapes may be employed for each segment 86.

The segments 86 are spaced apart by a stem 88 which may be formed as a continuous member between the shaft 40 and the upper arm 30 or as a plurality of interconnected stem sections, each generally aligned along a longitudinal axis of the handle 24 and the shaft 40.

As shown in FIG. 2, the stem 88 extends in one direction across the complete diameter of the shaft 40 from opposed diametrical edges of the segments 86. This prevents substantial flexing or movement of the segments 86 along a plane perpendicular to the first plane defined through the handle 24 and the head 26.

Figure 3:
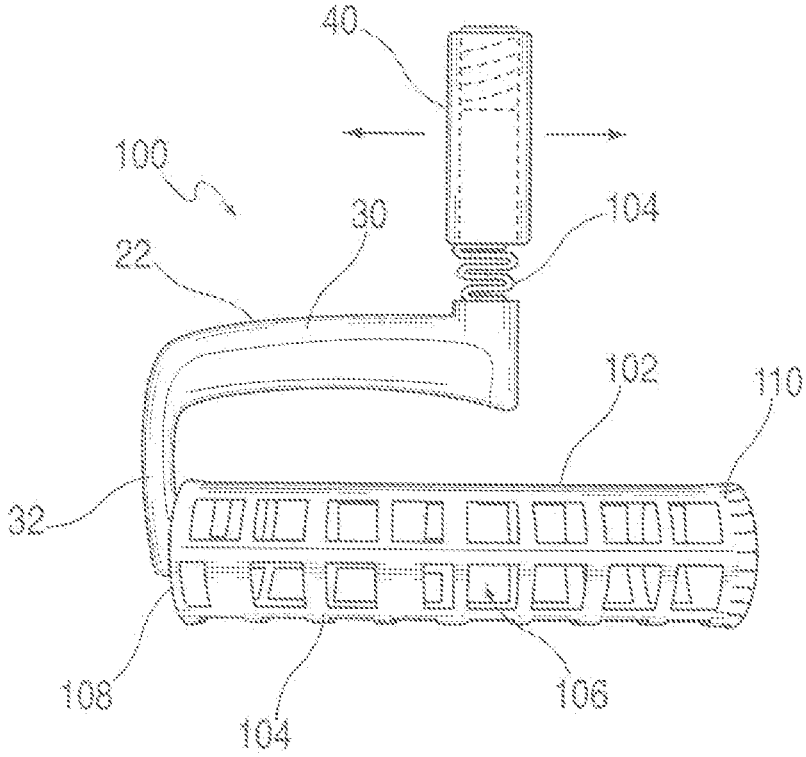
FIG. 3 is a front elevational view of a cleaning apparatus with another aspect of a flexible connection.
Figure 4:
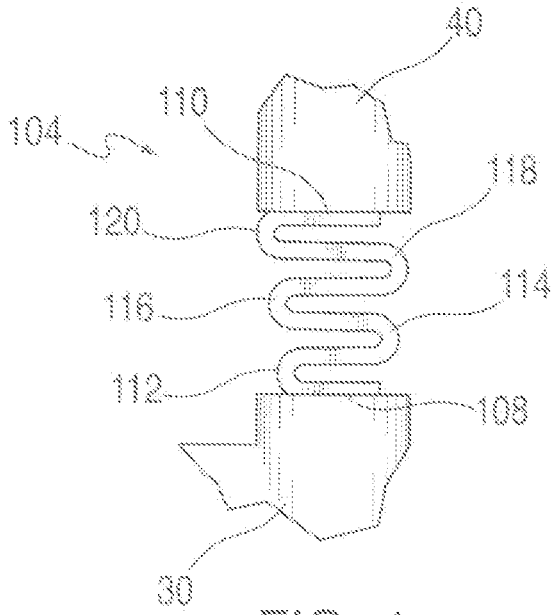
FIG. 4 is a partial, enlarged frontal elevational view showing the connection between the shaft and the arm of the cleaning apparatus shown in FIG. 3.

As shown in FIGS. 3 and 4, cleaning apparatus 100 is substantially the same as the cleaning apparatus 20 except for a different spindle 102 and a different connector 104. In this aspect, the spindle 102 is formed of a one piece molded body having interconnected solid portions 104 and open portions 106. End caps 108 and 110 are formed at opposite ends of the spindle 102 and receive a metal reinforcing rod, not shown, therethrough, as described above and shown in FIG. 1. The cleaning apparatus 100 includes a head 22 and a shaft 40 which are substantially the same as the corresponding elements described above and shown in FIG. 1.

The connector 42, in this aspect of the invention, is formed of a plurality of transversely extending, generally U-shaped folds 112, 114, 116, 118 and 120 between a first end 108 integrally connected, such as by molding, adhesive, fasteners, etc., to the upper arm 30 and an opposed second end 110 also integrally molded, adhesively joined and fastened to one end of the shaft 40. The folds 112, etc., are alternatingly inverted between the first and second ends 108 and 110. The degree of resiliency of the connector 104 may be varied by changing the thickness or width of the folds 112, 114, 116, 118 and 120 as well as the number of folds. For example, a less resilient connector 104 may be provided by increasing the thickness, increasing the width and/or as decreasing the number of the folds 112, 114, 116, 118 and 120. A more resilient connector 104 may be obtained by increasing the number of folds, decreasing the thickness and/or decreasing the width of the fold 112, 114, 116, 118 and 120.

By way of example only, the number of folds is between at least two folds and ten folds, with five folds 112, 114, 116, 118 and 120 being shown in FIGS. 3 and 4 as an example only.

As shown in FIG. 4, the length of each segment between the folded ends varies so that the length of the folds increases from the fold 112 to the fold 120. It will be understood that all of the folds 112, 114, 116, 118 and 120 may have the same length provided in a reverse increasing length from the end on the shaft 40 to the opposite end on the upper arm 30.

Figure 5:
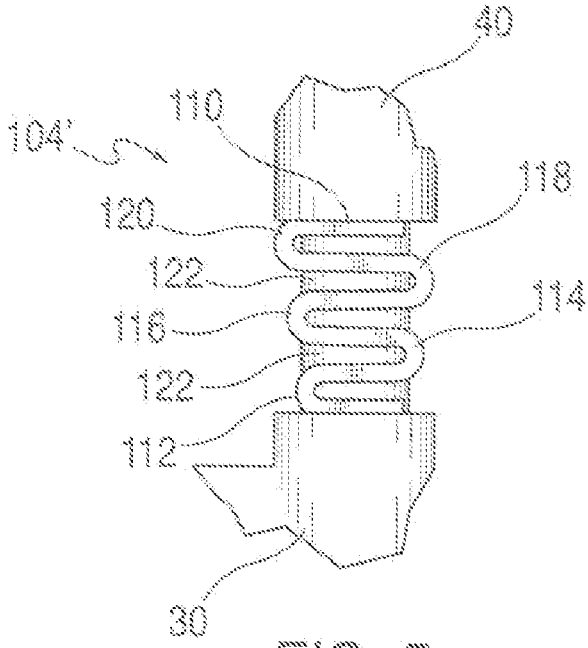
FIG. 5 is a partial, enlarged view, similar to FIG. 4, but depicting another aspect of the flexible connection of the present invention.

Another aspect of the connector 104 in FIG. 5. The connector 104 includes the same folds 112, 114, 116, 118 and 120. In this aspect, however, the open spaces between the generally U-shaped folds spaces are filled with a resilient, elastomeric or rubber material 122. This material 122 decreases the resiliency but provides a more controlled pivotal movement of the handle 24 relative to the head 22.

Figure 6:
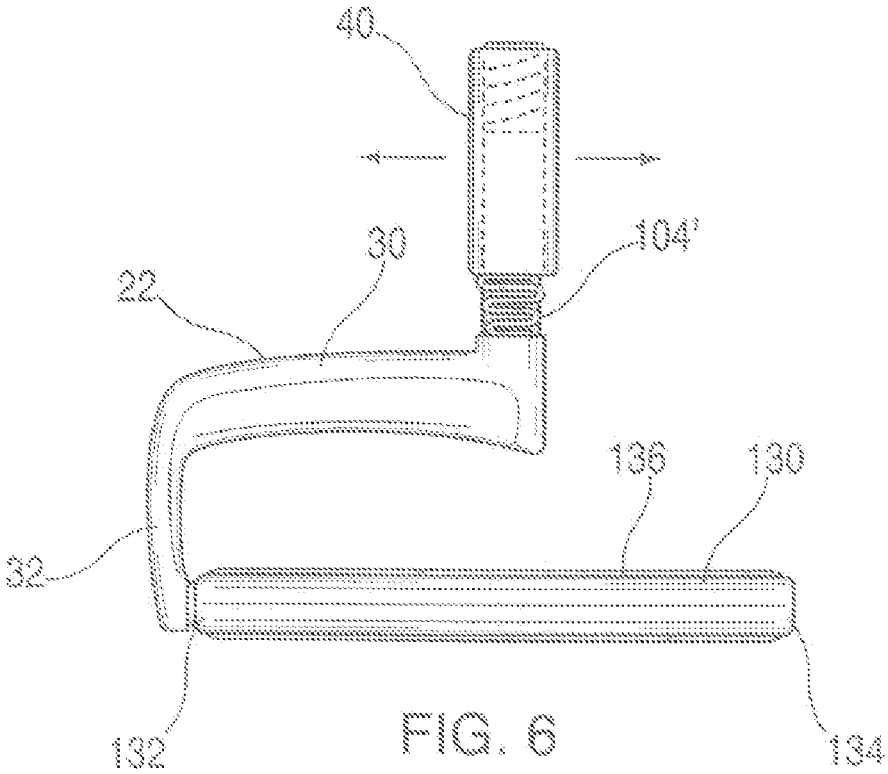
FIG. 6 is a front elevational view of another aspect of the cleaning apparatus according to the present invention, using the connection of FIG. 5.
Figure 7:
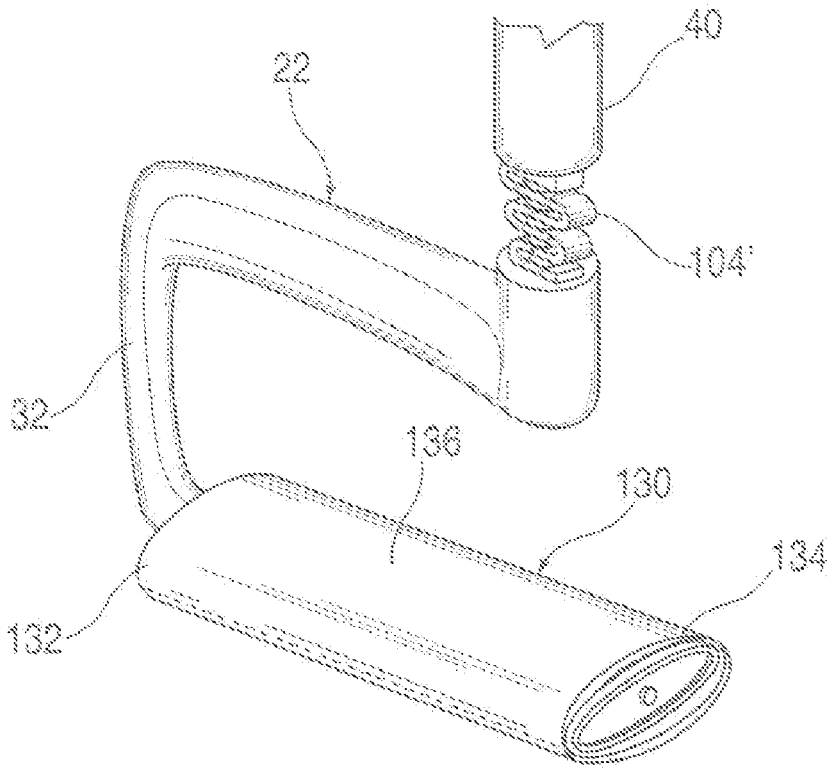
FIG. 7 is a perspective view of the cleaning apparatus shown in FIG. 6.

FIGS. 6 and 7 depict the cleaning apparatus 100 shown in FIG. 3, with a connector 104' and an oblate or oval shaped spindle 130. The spindle 130 may receive a roll of outwardly facing adhesive strips which are conformed to the oblate shape of the spindle 130 or a separate stack of sheets along one or opposite sides of the spindle 130, or as a continuous roll of perforated non-woven sheets.

The spindle 130 is similar to the spindle shown in Applicant's prior patent, U.S. Pat. No. 6,298,517 as shown in FIG. 7. The end portion 36 of the reinforcing rod 34 extends through one end cap 132 to an opposed end cap 134. Individual support rods, not shown, also extend between fixed connections on the end caps 132 and 134 to support a cleaning element 136 in the desired oblate shape on the spindle 130.

Figure 8:
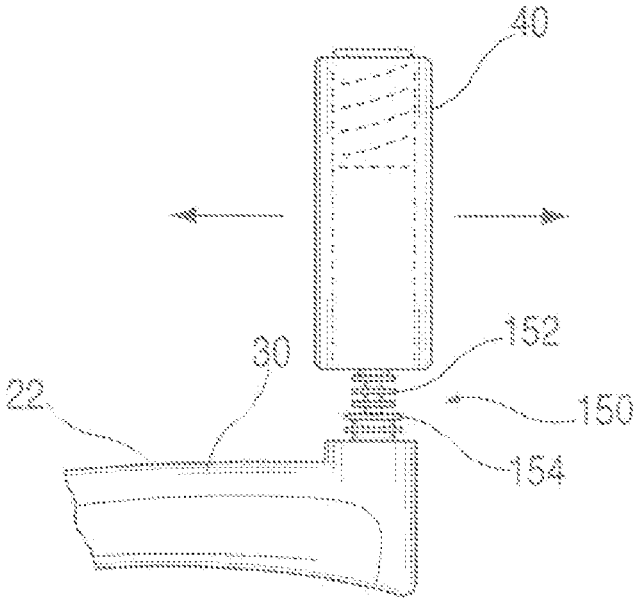
FIG. 8 is a partial, enlarged, front elevational views showing different aspects of connections for the cleaning apparatus of the present invention.

Yet another connector 150 is shown in FIG. 8. In this aspect, the connector 150 is connected at opposite ends to the shaft 40 and the upper arm 30 of the head 22. The individual segments 152 and 154 are similar to the planar segments 86 shown in FIG. 1 but are provided in different diameters, with the segments 152 having a first diameter and the segments 154 having a second larger diameter, by example only. It will also be understood that all of the segments, with five segments being shown in the connector 150 by way of example only, may have different diameters. Such as increasing diameters from segment to segment from one end of the connector 150 at the shaft 40 to an opposite end at the upper arm 30.

Figure 9:
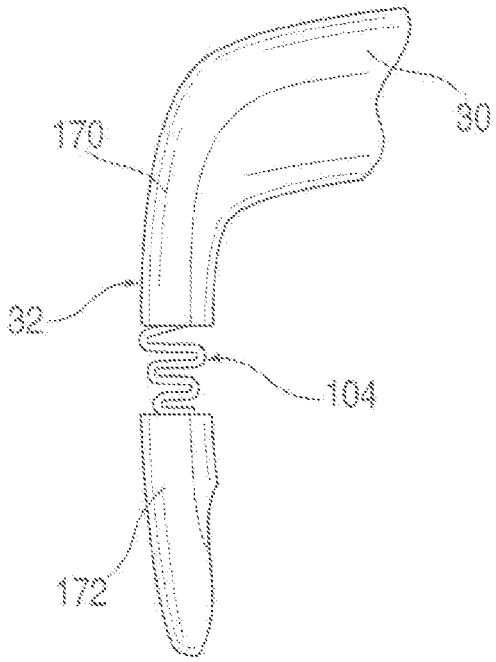
FIGS. 9, 10, 11 and 12 are enlarged, partial front elevational views showing an alternate mounting location for the connections of the present inventions.
Figure 10:
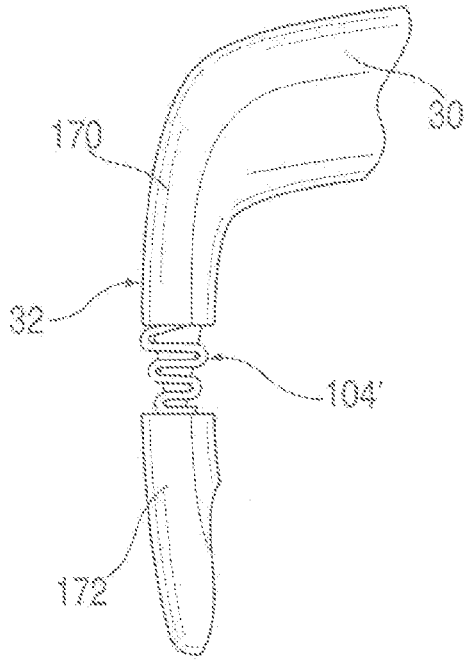
Figure 11:
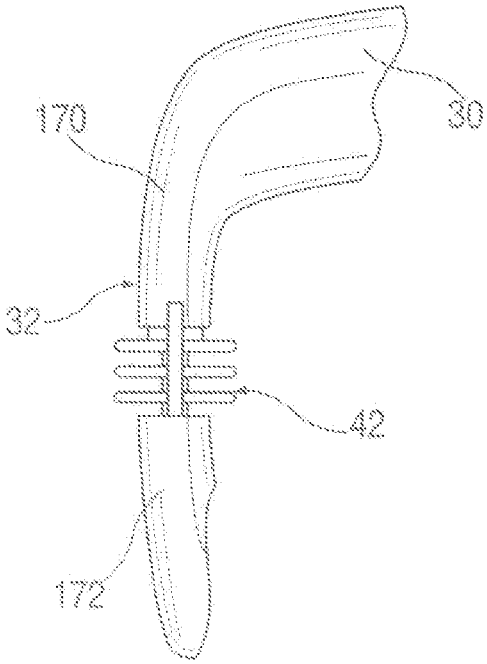
Figure 12:
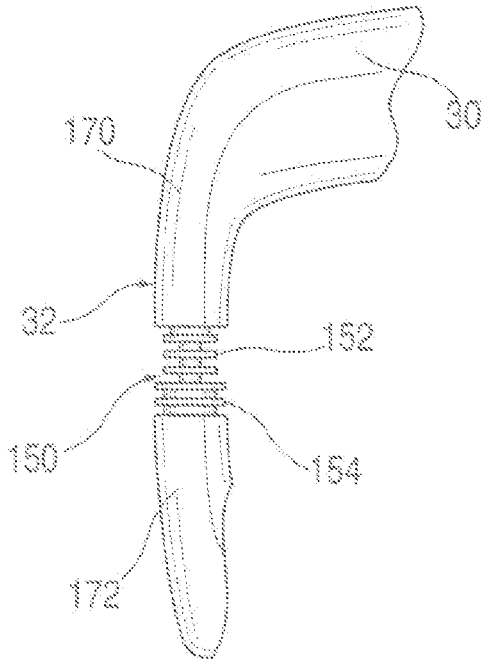

Referring now to FIGS. 9-12, there is depicted use of the various connectors described above in a different mounting position on the cleaning apparatus of the present invention. In these aspects of the invention, the various connectors are mounted in the side arm 32 intermediately between an upper side arm portion 170 and a lower side arm portion 172. As shown in FIG. 9, the connector 104 is mounted between the side arm portions 170 and 172. In Fig. the connector 104' is likewise mounted between the side arm portions 170 and 172. In FIG. 11, the connector 42 is likewise mounted between the side arm portions 170 and 172. In FIG. 12, the connector 150 is integrally formed between the upper and lower side arm portions 170 and 172.

It will be understood that the use of the connectors 104 and 104' in FIGS. 10 and 11, the side arm 32 will typically require the side arm 32 to be formed as a one piece member. The same one piece side arm construction may also apply for the use of the connectors 42 and 150 in the side arm 32 as shown in FIGS. 11 and 12.

Although this aspect of the invention utilizes the cleaning apparatus shown in FIG. 6, it will be understood that the connector 180 described hereafter may be employed in place of any of the other connectors described above as part of this invention.

Figure 13:
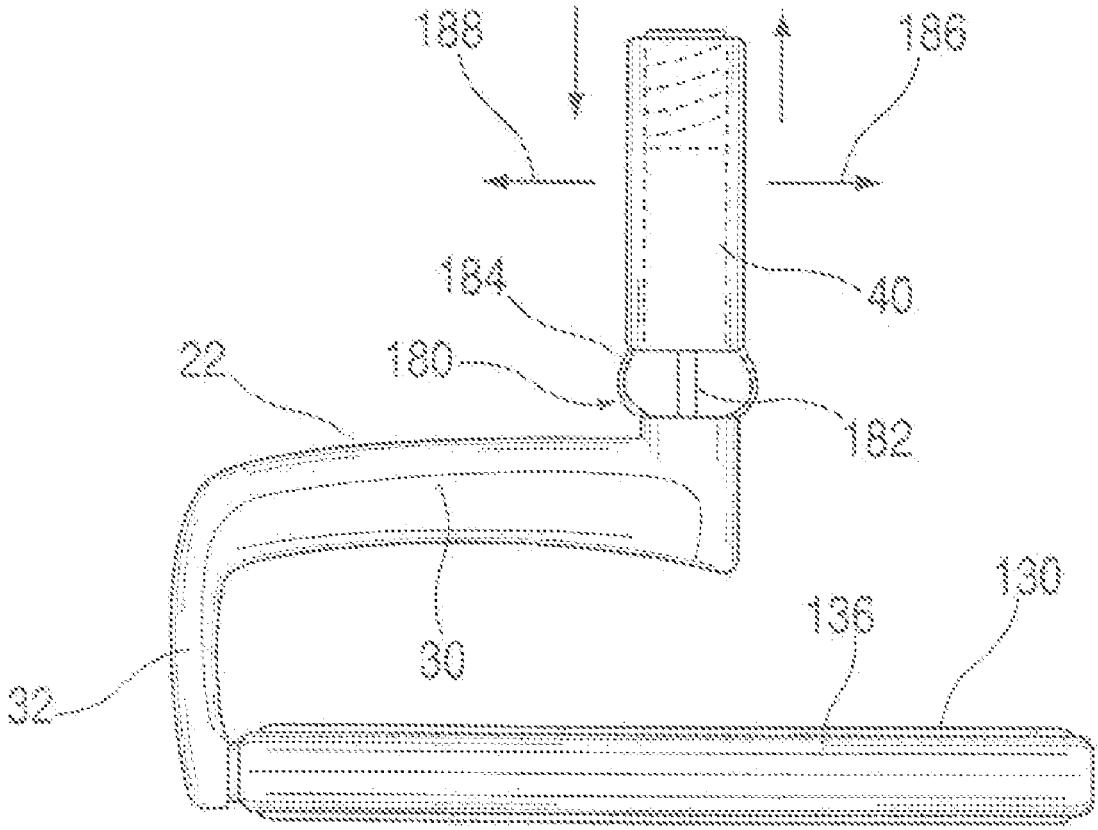
FIG. 13 is a frontal elevational view of a cleaning apparatus according to the present invention including another aspect of a flexible connection.

As shown in FIG. 13, the connector 180 includes a thin web 182 which extends substantially across the diameter of the shaft 40 and the end of the upper arm 30. The web 182, which may be integrally formed, such as by molding, with the shaft 40 in the upper arm 30, has a significantly smaller width or cross-sectional dimension than its corresponding length dimension.

The resulting open space between the end of the shaft 40 and the mating portion of the upper arm 30 is filled with a mass 184 of a resilient material, such as an elastomeric or rubber material which is cured to a solid, but resilient form.

In use, the connector 180 allows lateral movement between the shaft 40 and the head 30 in the direction of arrows 186 and 188 of approximately 30° to 150°, etc. At the same time, due to the length of the web 182, perpendicular movement of the shaft 40 relative to the upper arm is limited to at most 20°.

Figure 14:
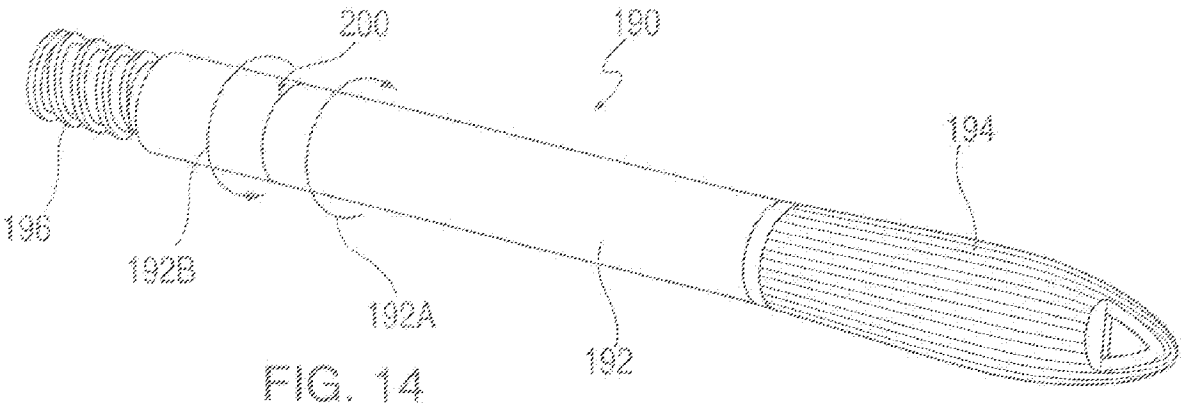
FIG. 14 is a perspective view of one aspect of a handle employable in the cleaning apparatus of the present invention.

Refer now to FIG. 14, there is depicted an alternate elongated handle 190 which may be used with any of the cleaning apparatus described above and shown in FIGS. 1-13. The handle 140 includes an elongated shaft portion 192 which terminates in a hand grip 194. The hand grip 194 may be formed with or covered with a resilient pad forming a suitable hand gripping surface. The opposite end 196 on the shaft 192 is formed with a suitable mating connector to the connector in the shaft 40, the thread shown on the end 196 in FIG. 14 will be understood to be by way of example only.

The handle 190 can be connected directly to the shaft 40 or to the handle 24 shown in FIG. 1 where a mating connector, such as internal threads, are formed in the end of the handle 24. This allows the extension handle 190 to be easily employed when necessary, but separated from the handle 24 when not required.

According to a unique feature, the handle 190 includes an intermediate rotatable connection 200 between the hand grip 194 and the end 196. The rotatable connection 200 provides a small amount of angular displacement between the opposed shaft portions denoted by Ref Nos. 192A and 192B of the shaft 192. This will accommodate different hand positions relative to the head 22 or the application of a slight amount of torque to the head 22.

Figure 15:
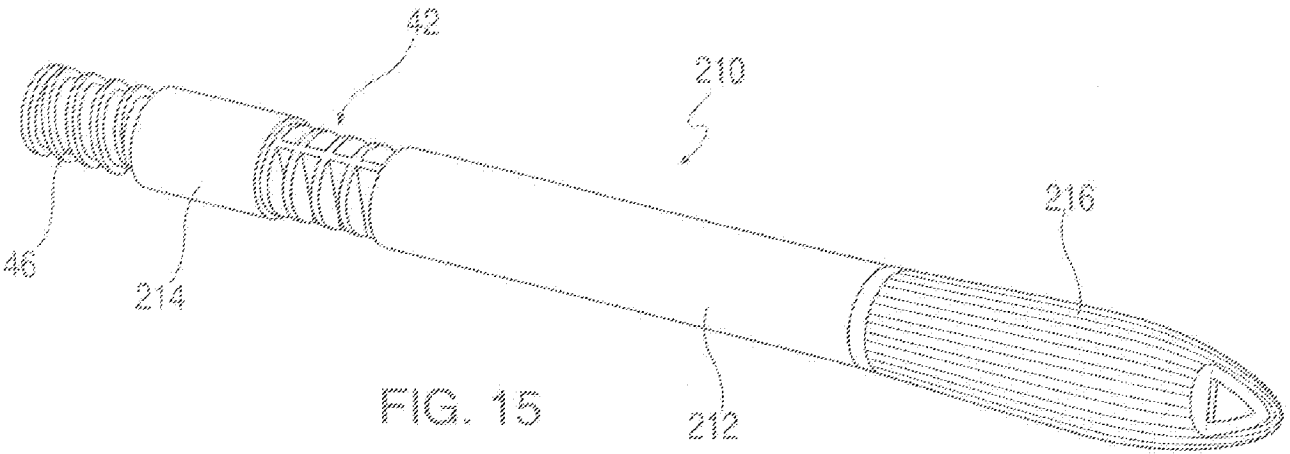
FIG. 15 is a perspective view of another aspect of the flexible connector.

Referring now to FIG. 15, there is depicted another aspect of a handle 210 which may be employed with any of the cleaning apparatus described above and shown in FIGS. 1-13. The handle 210 includes a first or a main shaft portion 212, a second shaft portion 214 having the head connector, such as threads 46, extending from one end and a gripped end 216. The grip end 216 may also provide for a releasible connection to a handle extension, not shown.

Any of the flexible connectors described above, such as connector 42 shown in FIG. 15 by way of example only, may be formed between the shaft sections 212 and 214. When mounted in the handle 210, the flexible connector 42 functions in the same manner as the use of all of the flexible connector regardless of whether the connectors are mounted in the head or shaft, by allowing more substantial movement of the handle 210 relative to the head 22 in the first plane than a substantially lesser amount of movement in a second, mutually exclusive, generally angular or perpendicular plane.

In conclusion, there has been disclosed a unique flexible connection for a cleaning apparatus which provides economic and efficient pressure application during use of the cleaning apparatus. The flexible connector is easily integrated into a cleaning apparatus carrying an outwardly facing adhesive roll or sheet stack and may be provided with different degrees of flexibility or resiliency by varying the shape of the connector.

What is claimed is:

1. A cleaning apparatus comprising:

a handle;

a head coupled to the handle and including an upper arm and a side arm;

a spindle carried by the head;

at least one cleaning element carried on the spindle;

a reinforcing member having one end fixed in the upper arm and the other end projecting laterally inwardly from said side arm and received in said spindle; and a flexible connector between the handle and the head permitting more movement of the handle relative to the head in a first direction than in a substantially perpendicular second direction.

2. The cleaning apparatus of claim 1, wherein:

the flexible connector is coupled to a shaft that connects the head to the handle.

3. The cleaning apparatus of claim 1, wherein:

the handle and the head define a first plane, the flexible portion permitting more movement of the handle relative to the head in the first plane than in a second mutually exclusive, angularly disposed plane.

4. The cleaning apparatus of claim 3, wherein the flexible connector comprises:

a plurality of spaced apart segments.

5. The cleaning apparatus of claim 4, further comprising:

a mass of resilient material disposed about the folds.

6. The cleaning apparatus of claim 1, wherein:

the spindle has a circular cross-section.

7. The cleaning apparatus of claim 1, wherein:

the handle is releasably connected to the shaft.

8. The cleaning apparatus of claim 7, further comprising:

mating threads formed in the handle and the shaft.

9. The cleaning apparatus of claim 1, further comprising:

resilient material carried on the handle.

10. The cleaning apparatus of claim 1, further comprising:

resilient material carried on the head.

11. The apparatus of claim 1, wherein at least one resilient insert is mounted on both the upper and side arms of the head.

12. The apparatus of claim 1, wherein said other end of said reinforcing member projects laterally inwardly from the side arm in a direction that is parallel to the upper arm.

13. The apparatus of claim 1, further including a shaft coupled to the upper arm for releasably connecting the handle to the head.

14. The apparatus of claim 1, wherein the spindle includes a cartridge having first and second ends joined by a plurality of longitudinally extending strips.

15. The apparatus of claim 14, wherein said cleaning element is mounted on the cartridge.

16. The apparatus of claim 1, wherein the spindle has first and second end caps with one of said end caps having an opening through which said other end of said reinforcing member extends.

17. The apparatus of claim 16, wherein the spindle has an interior bearing member for rotatably receiving said second end of said reinforcing member.

18. The apparatus of claim 1, wherein the spindle is capable of bi-directional rotation.

* * * * *